US010916876B2

(12) United States Patent
Maesoba et al.

(10) Patent No.: US 10,916,876 B2
(45) **Date of Patent: *Feb. 9, 2021**

(54) TERMINAL UNIT AND CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/492,983

(22) PCT Filed: Feb. 21, 2018

(86) PCT No.: PCT/JP2018/006266
§ 371 (c)(1),
(2) Date: Sep. 11, 2019

(87) PCT Pub. No.: WO2018/168368
PCT Pub. Date: Sep. 20, 2018

(65) Prior Publication Data

US 2020/0021054 A1 Jan. 16, 2020

(30) Foreign Application Priority Data

Mar. 13, 2017 (JP) ..... 2017-046961

(51) Int. Cl.
*H01R 13/436* (2006.01)
*H01R 4/18* (2006.01)
(Continued)

(52) U.S. Cl.
CPC ..... *H01R 13/4365* (2013.01); *H01R 4/185* (2013.01); *H01R 13/113* (2013.01);
(Continued)

(58) Field of Classification Search
CPC .. H01R 13/4365; H01R 4/185; H01R 13/113; H01R 13/4361; H01R 13/502;
(Continued)

(56) References Cited

U.S. PATENT DOCUMENTS

2015/0155670 A1 6/2015 Gardner
2018/0254579 A1* 9/2018 Miyamura ..... H01R 13/533
(Continued)

FOREIGN PATENT DOCUMENTS

DE 112018001279 T8 * 12/2019 ..... H01R 13/04
JP 7-176342 7/1995
(Continued)

OTHER PUBLICATIONS

International Search Report dated Apr. 24, 2018.

*Primary Examiner* — Travis S Chambers
(74) *Attorney, Agent, or Firm* — Gerald E. Hespos; Michael J. Porco; Matthew T. Hespos

(57) ABSTRACT

A terminal unit (30) includes inner conductors (31) having tabs (33) projecting from body portions (32) and a dielectric (40) configured to hold the inner conductors (31) while accommodating the bodies (32), and is mountable into a selected one of a first housing (10) and a second housing (20). The terminal unit (30) inserted into the first housing (10) is retained by a front retainer (17) restricting the resilient deflection of a first locking lance (14) and a first locking portion (47) being locked to the first locking lance (14). The terminal unit (30) inserted into the second housing (20) is retained by the locking of the first locking portion (47) and a second locking lance (22) and the locking of
(Continued)

second locking portions (51) of the dielectric (40) and a side retainer (25).

6 Claims, 10 Drawing Sheets

(51) Int. Cl.
*H01R 13/11* (2006.01)
*H01R 13/502* (2006.01)
*H01R 43/20* (2006.01)

(52) U.S. Cl.
CPC ..... *H01R 13/4361* (2013.01); *H01R 13/502* (2013.01); *H01R 43/20* (2013.01)

(58) Field of Classification Search
CPC ..... H01R 43/20; H01R 13/4362; H01R 9/00; H01R 13/4223; H01R 13/4226; H01R 13/516
USPC ..... 439/752, 595, 733.1
See application file for complete search history.

(56) References Cited

U.S. PATENT DOCUMENTS

| | | | | |
|---|---|---|---|---|
| 2018/0261945 | A1* | 9/2018 | Maesoba ..... | H01R 13/422 |
| 2019/0006792 | A1* | 1/2019 | Yamanaka ..... | H01R 13/64 |
| 2020/0083633 | A1* | 3/2020 | Maesoba ..... | H01R 43/20 |

FOREIGN PATENT DOCUMENTS

| | | |
|---|---|---|
| JP | 10-162888 | 6/1998 |
| JP | 10-321280 | 12/1998 |
| JP | 2002-319456 | 10/2002 |
| JP | 2012-129103 | 7/2012 |
| JP | 2014-120484 | 6/2014 |
| JP | 2015-537327 | 12/2015 |

* cited by examiner

TERMINAL UNIT AND CONNECTOR

BACKGROUND

Field of the Invention

The invention relates to a terminal unit and a connector.

Related Art

Japanese Unexamined Patent Publication No. 2012-129103 discloses a connector with a terminal unit that has an inner conductor terminal in a dielectric and a housing for accommodating the terminal unit. A resiliently deflectable locking lance is formed in the housing and a locking projection is formed on an outer surface of the dielectric for retaining and holding the terminal unit in the housing.

There is a concern that resiliently deflectable locking lance may be disengaged from the locking projection due to an impact, vibration or the like. Thus, it is desired to improve the reliability of a function for retaining the terminal unit.

The invention was completed on the basis of the above situation and aims to improve the reliability of a function for retaining a terminal unit.

SUMMARY

A first aspect of the invention is directed to a terminal unit with an inner conductor including a tab projecting forward from a body and a dielectric configured to hold the inner conductor while accommodating the body. The terminal unit is mountable into a selected one of a first housing and a second housing. The first housing includes a resiliently deflectable first locking lance, a front retainer capable of restricting resilient deflection of the first locking lance and a first accommodation chamber. The second housing includes a resiliently deflectable second locking lance, a second accommodation chamber and a side retainer facing the second accommodation chamber. A first locking portion and a second locking portion are formed on an outer surface of the dielectric. The terminal unit that is inserted in the first accommodation chamber is retained by the front retainer restricting the resilient deflection of the first locking lance, and the first locking portion being locked to the first locking lance, and the terminal unit that is inserted in the second accommodation chamber is retained by locking of the first locking portion and the second locking lance and locking of the second locking portion and the side retainer.

A second aspect of the invention is directed to a connector configured by inserting a terminal unit into a selected one of a first accommodation chamber formed in a first housing and a second accommodation chamber formed in a second housing. The terminal unit includes an inner conductor having a tab projecting forward from a body and a dielectric configured to hold the inner conductor while accommodating the body. The connector includes a resiliently deflectable first locking lance formed in the first accommodation chamber, a front retainer configured to restrict resilient deflection of the first locking lance by being mounted into the first housing. The connector also includes a resiliently deflectable second locking lance formed in the second accommodation chamber, and a side retainer mounted into the second housing to face inside of the second accommodation chamber. A first locking portion is formed on an outer surface of the dielectric and is configured to retain the terminal unit by being locked to the first locking lance when the terminal unit is inserted into the first accommodation chamber and to retain the terminal unit by being locked to the second locking lance when the terminal unit is inserted into the second accommodation chamber. A second locking portion is formed on the outer surface of the dielectric and is configured to retain the terminal unit by being locked to the side retainer when the terminal unit is inserted into the second accommodation chamber.

When the terminal unit is inserted into the first accommodation chamber, the first locking portion is locked to the first locking lance and the front retainer is mounted into the first housing to restrict the resilient deflection of the locking lance so that the terminal unit can be retained reliably. When the terminal unit is inserted into the second accommodation chamber, the first locking portion is locked to the second locking lance and the side retainer is locked to the second locking portion so that the terminal unit can be retained reliably. The terminal unit can be used as a common member for the first housing and the second housing of different types.

The first and second locking portions may be on the same plane of the outer surface of the dielectric but at different positions in a width direction intersecting an inserting direction into the first or second accommodation chamber. According to this configuration, the interference of the first locking portion with the side retainer and the interference of the second locking portion with the first and second locking lances is avoided while the first and second locking portions are disposed on the same plane.

A front stop may be formed on a front of the second locking portion in the inserting direction on the outer surface of the dielectric and may be configured to restrict a movement of the terminal unit inserted into the first or second accommodation chamber beyond a proper insertion position. The first and second locking lances do not resiliently come into contact at a position where the front stop is formed. Thus, even though the front stop is formed on the same plane as the first locking portion, insertion resistance due to the resilient interference with the first or second locking lance is not generated.

The second locking portion and the front stop may be formed integrally to a single projection. According to this configuration, the strengths of the second locking portion and the front stop can be enhanced as compared to the case where the second locking portion and the front stop portion project separately.

Two of the projections may be disposed on both sides across the first locking portion in the width direction intersecting the inserting direction into the first accommodation chamber or the second accommodation chamber. According to this configuration, the two projections sandwich the first or second locking lance locked by the first locking portion to prevent a positional deviation of the first or second locking lance in the width direction.

DETAILED DESCRIPTION

An embodiment of the invention is described with reference to FIGS. 1 to 12. Note that, in the following description, a left side in FIGS. 1 to 12 is defined as a front side concerning a front-rear direction. Upper and lower sides shown in FIGS. 1 to 10 and 12 are directly defined as upper and lower sides concerning a vertical direction.

A terminal unit 30 of this embodiment constitutes a first connector A (connector as claimed) of a waterproof type by being mounted into a first housing 10 and constitutes a second connector B (connector as claimed) of a non-waterproof type by being mounted into a second housing 20.

Figure 1:
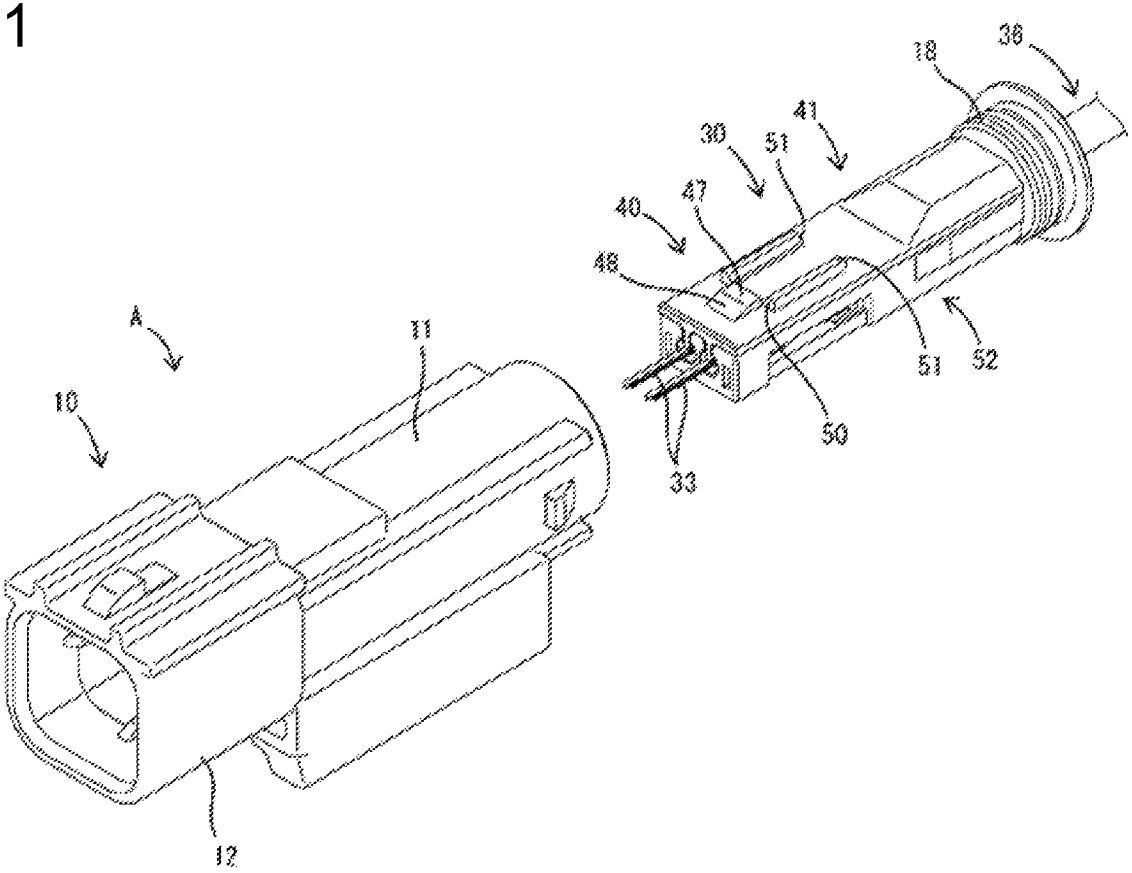
FIG. 1 is a perspective view showing a state where a first housing and a terminal unit are separated in a first connector in one embodiment.
Figure 2:
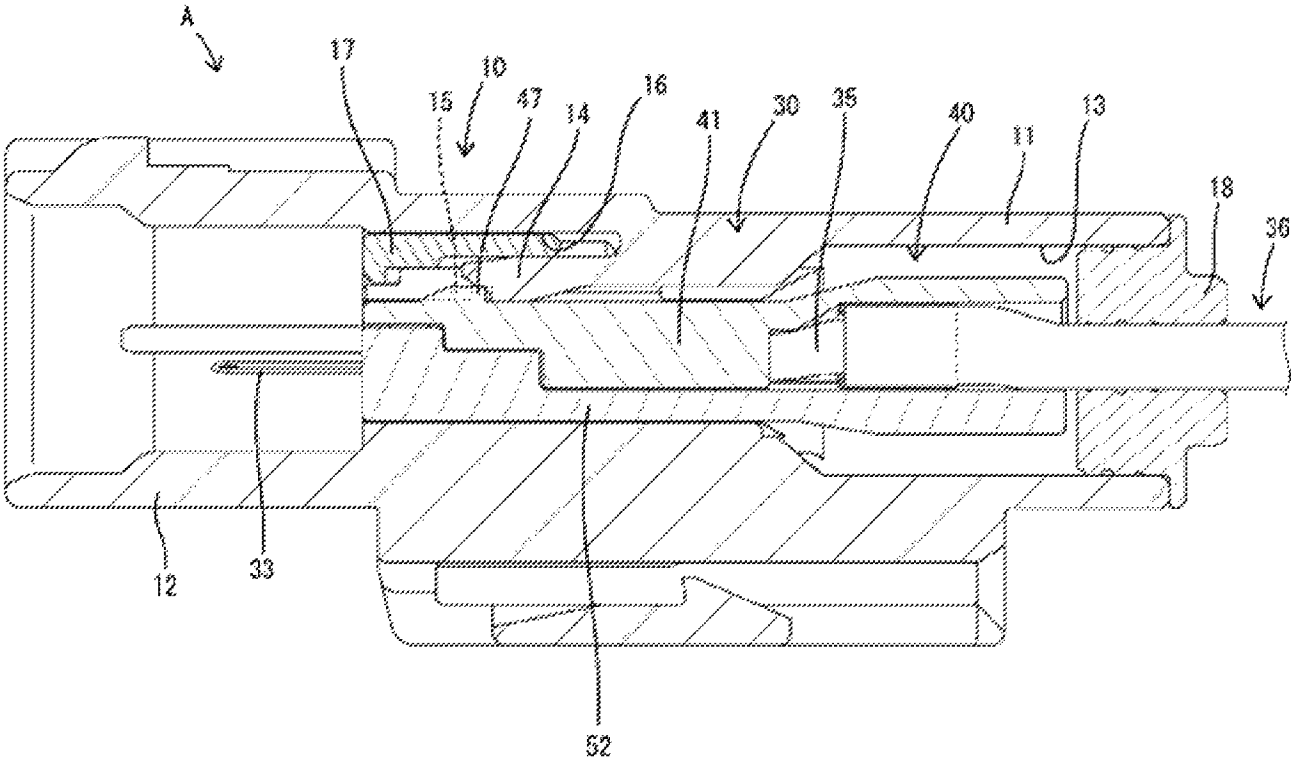
FIG. 2 is a side view in section showing a state where a front retainer is at a full locking position in the first connector.
Figure 3:
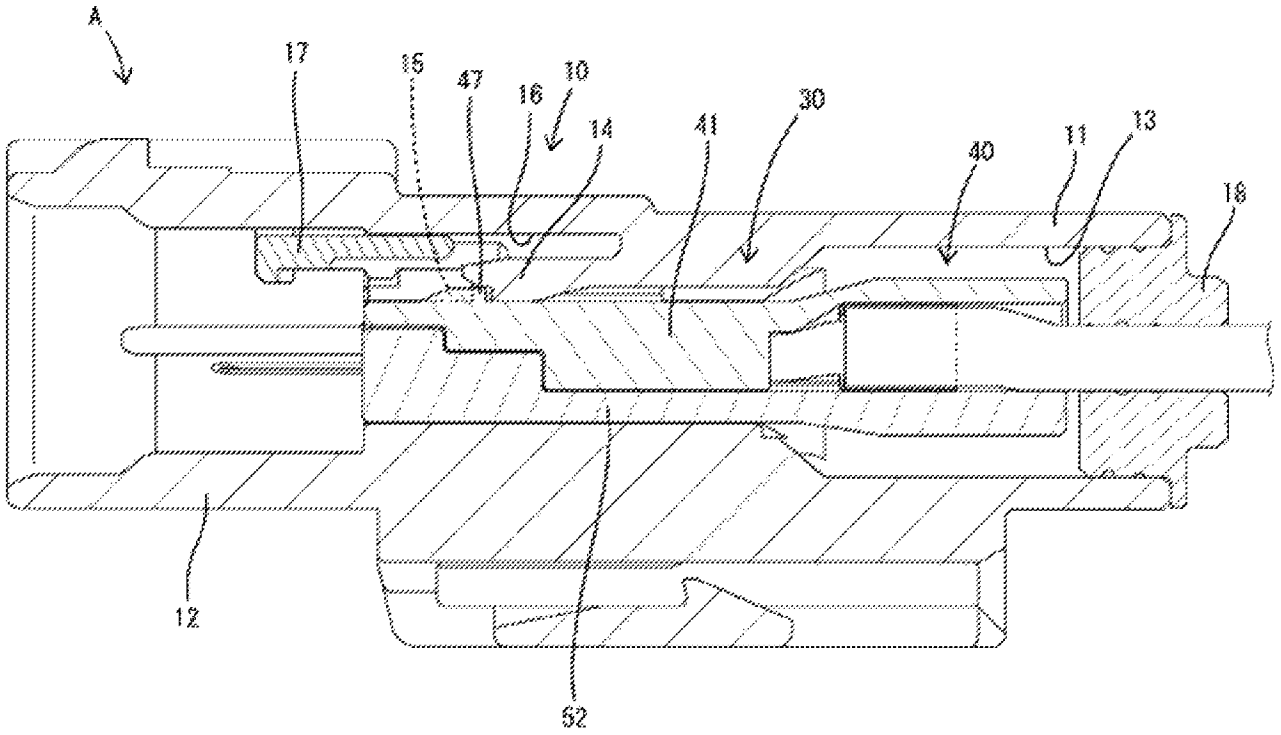
FIG. 3 is a side view in section showing a state where the front retainer is at a partial locking position in the first connector.

The first housing 10 is made of synthetic resin and, as shown in FIGS. 2 and 3, is a single component including an accommodating portion 11 and a receptacle 12 projecting forward from the outer periphery of the front end of the accommodating portion 11. A first accommodation chamber 13 is formed inside the accommodating portion 11. The terminal unit 30 is inserted into the accommodation chamber 13 from behind the first housing 10. A first locking lance 14 is cantilevered forward from an inner upper surface of the first accommodation chamber 13 and is resiliently deflectable upward. Step-like first stoppers 15 are formed on the inner upper surface of the first accommodation chamber 13.

The accommodating portion 11 is formed with a deflection space 16 for allowing the first locking lance 14 to be deflected resiliently up. A front retainer 17 is mounted into the accommodating portion 11 from the front of the first housing 10. The front retainer 17 mounted in the accommodating portion 11 is movable in the front-rear direction between a partial locking position where the front retainer 17 is forward of the deflection space 16 to allow resilient deflection of the first locking lance 14, as shown in FIG. 3, and a full locking position where the front retainer 17 enters the deflection space 16 to restrict the resilient deflection of the first locking lance 14, as shown in FIG. 2. The deflection space 16 is not open in the outer peripheral surface of the accommodating portion 11 and is open in the front surface of the accommodating portion 11.

Figure 4:
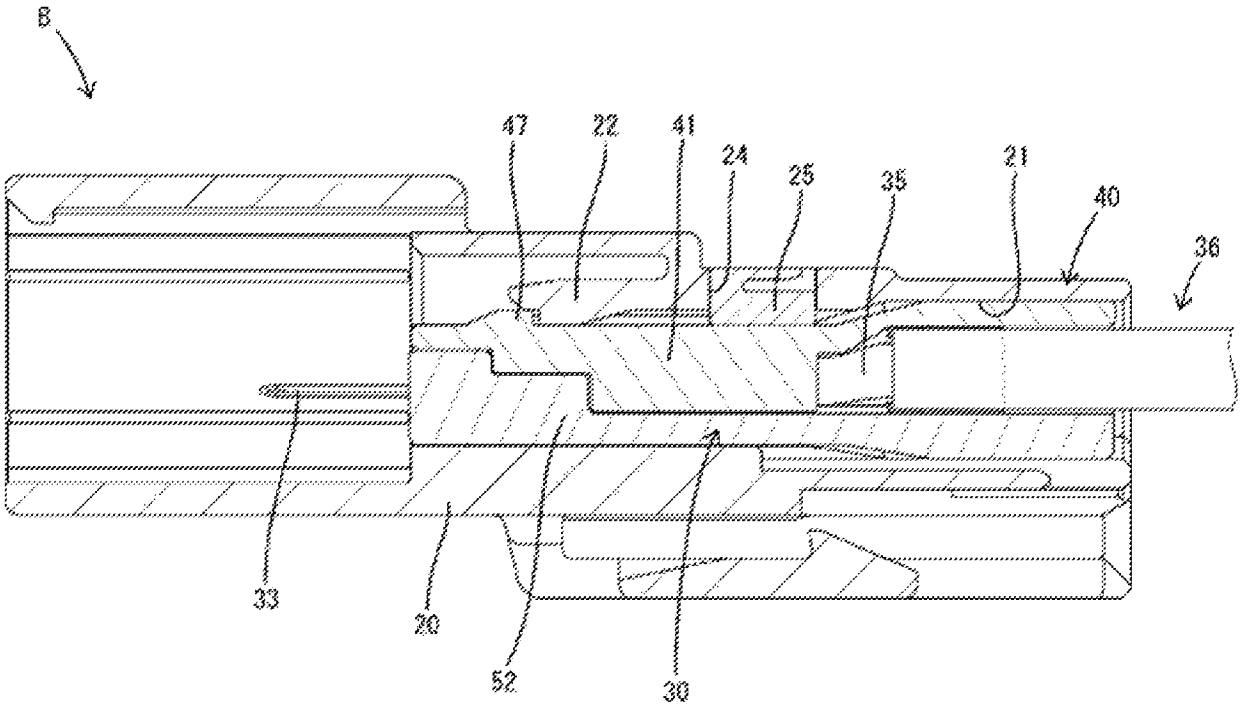
FIG. 4 is a side view in section showing a state where a side retainer is at a full locking position in a second connector.
Figure 5:
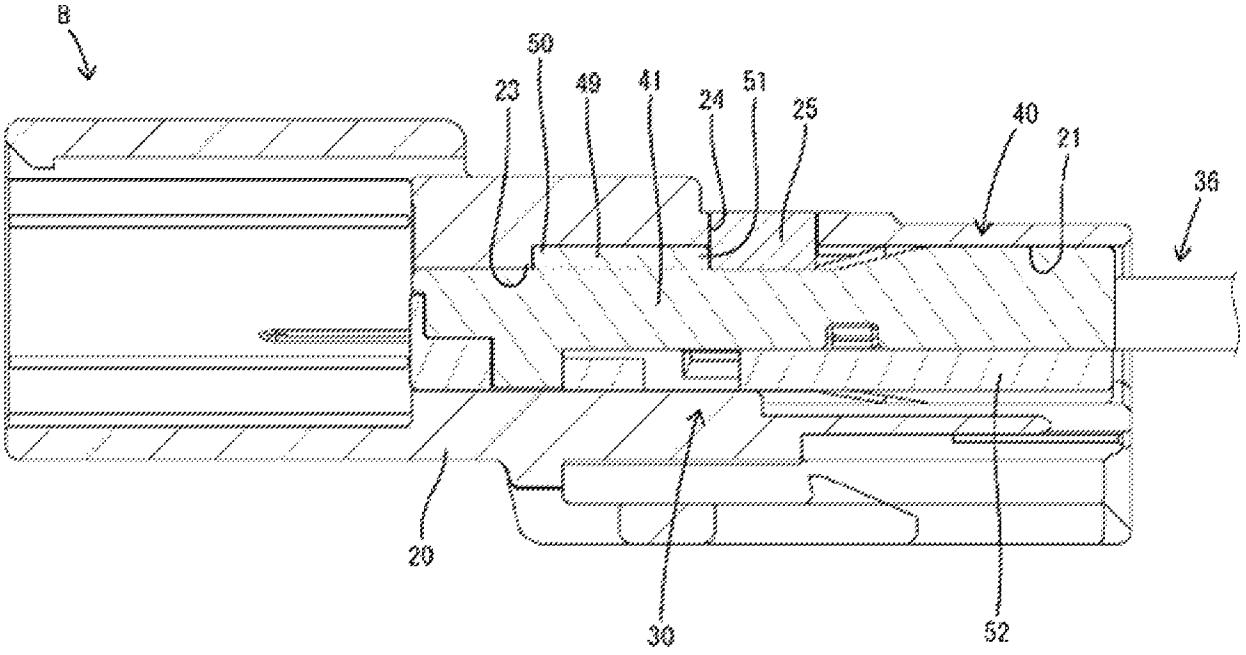
FIG. 5 is a side view in section showing a state where the side retainer at the full locking position and second locking portions are locked in the second connector.
Figure 6:
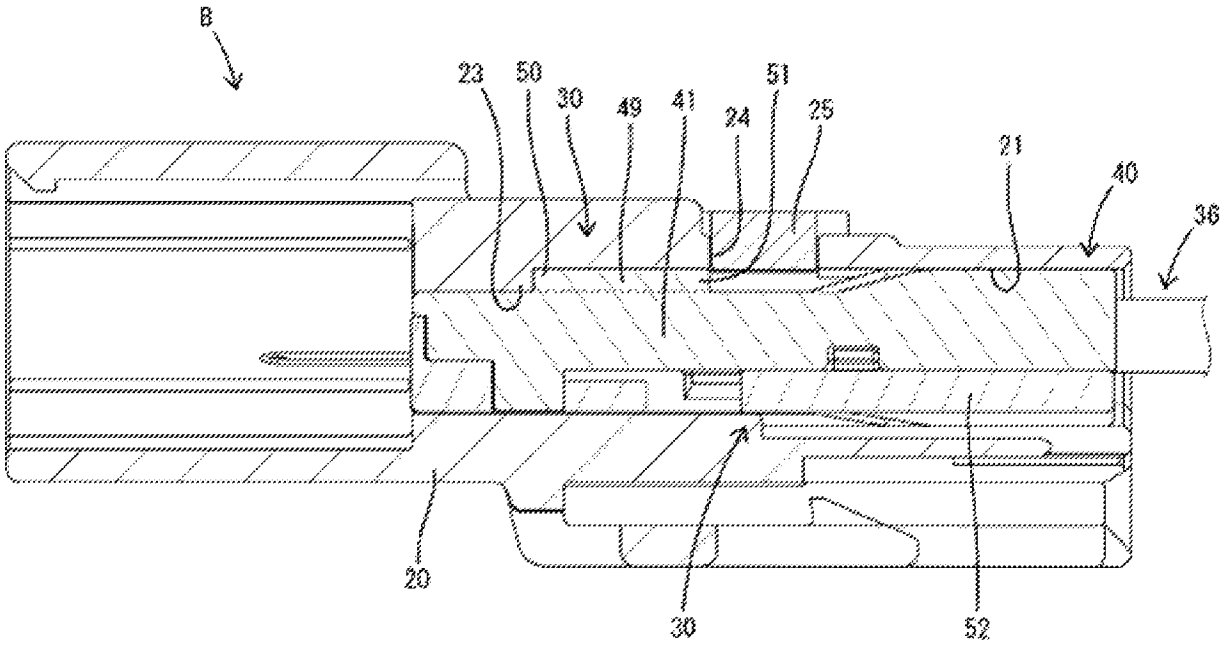
FIG. 6 is a side view in section showing a state where the side retainer is at a partial locking position in the second connector.
Figure 7:
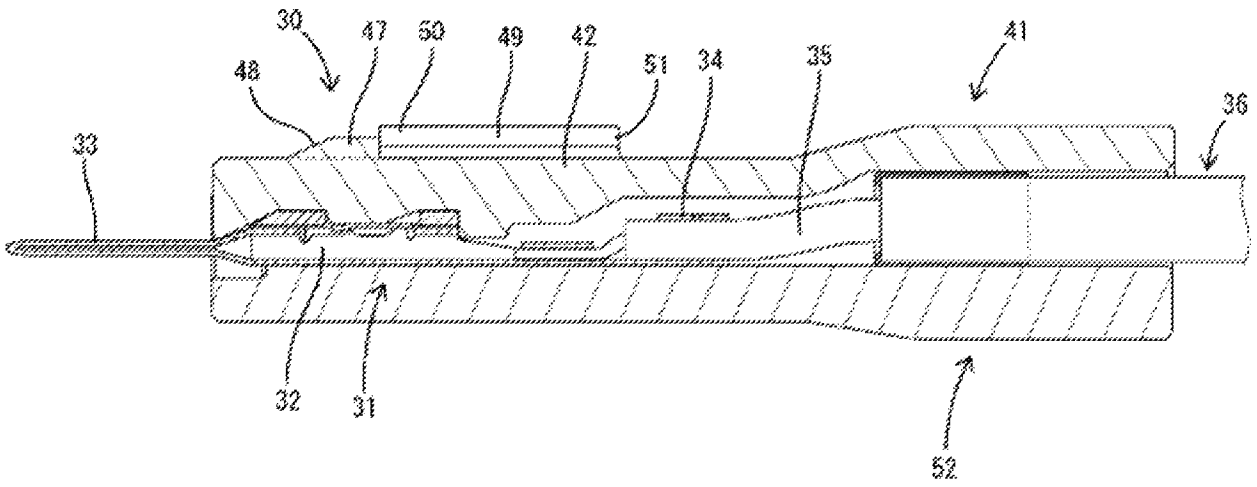
FIG. 7 is a side view in section of the terminal unit.
Figure 8:
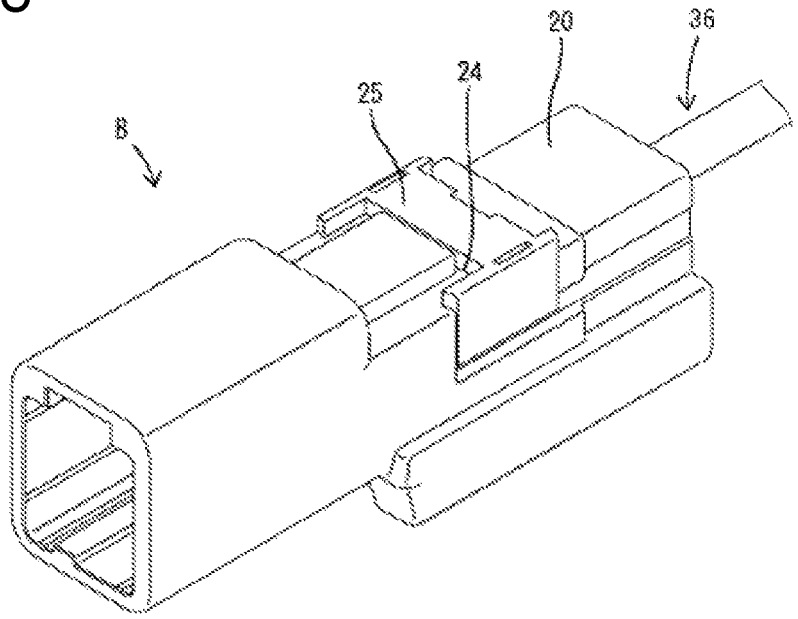
FIG. 8 is a perspective view showing a state where the terminal unit is mounted in a second housing in the second connector.
Figure 9:
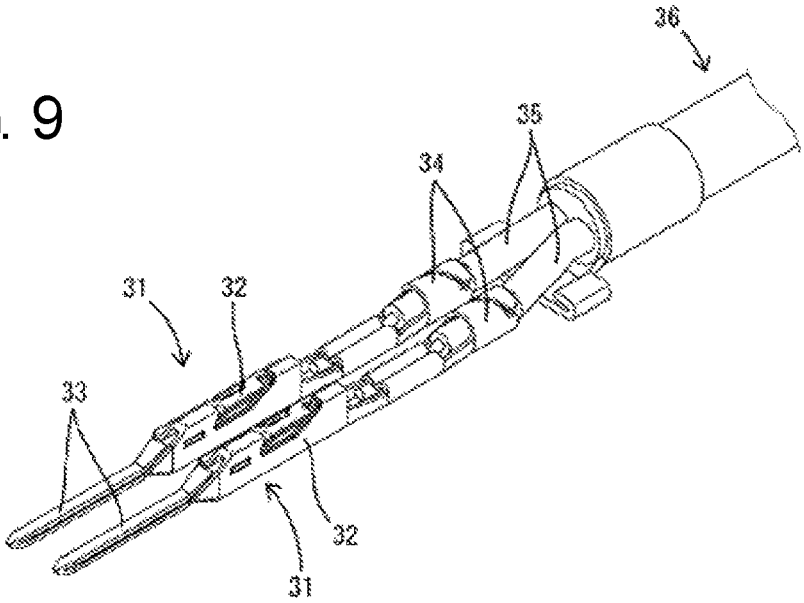
FIG. 9 is a perspective view showing a state where inner conductors and a twisted pair cable are connected.
Figure 10:
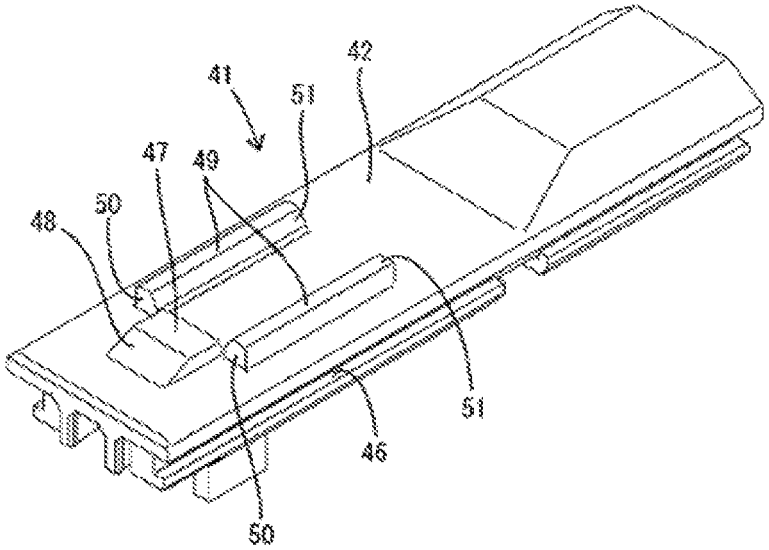
FIG. 10 is a perspective view of a first component.
Figure 11:
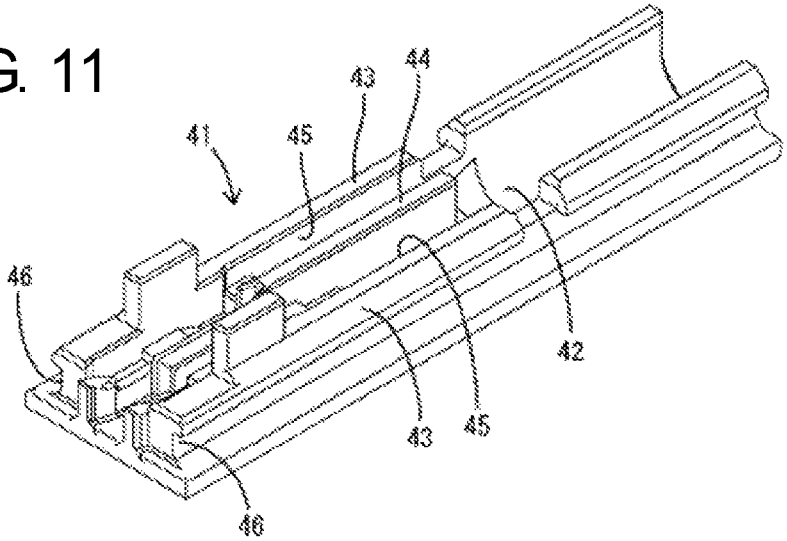
FIG. 11 is a perspective view of the first component in a vertically inverted state.
Figure 12:
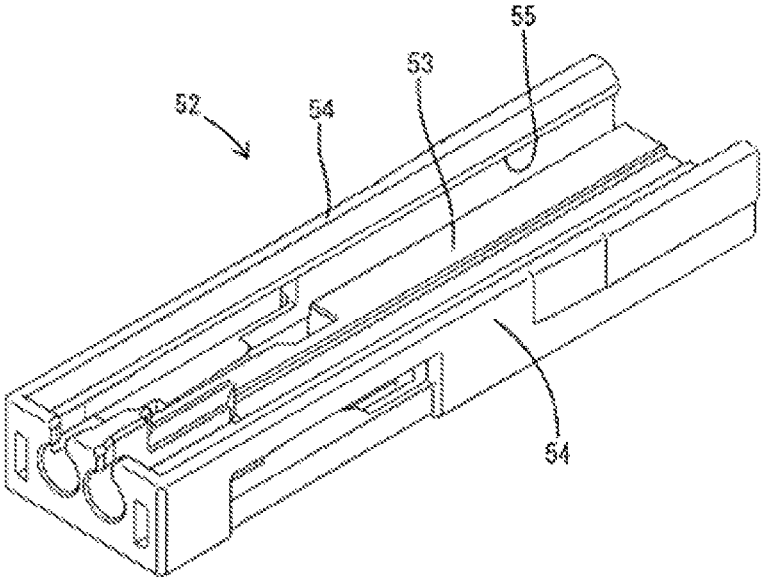
FIG. 12 is a perspective view of a second component.

The second housing 20 is made of synthetic resin. As shown in FIGS. 4 to 6, a second accommodation chamber 21 is formed inside the second housing 20. The terminal unit 30 is inserted into the second accommodation chamber 21 from behind the second housing 20. A second locking lance 22 is cantilevered forward from an inner upper surface of the second accommodation chamber 21 and is resiliently deflectable upward. Step-like second stoppers 23 are formed on the inner upper surface of the second accommodation chamber 21.

A mounting hole 24 is formed through the upper surface of the second housing 20 and communicates with the inside of the second accommodation chamber 21. The mounting hole 24 is disposed behind the second locking lance 22. A side retainer 25 is mounted into the mounting hole 24 and is movable vertically (direction intersecting an inserting/withdrawing direction of the terminal unit 30 into and from the second accommodation chamber 21) between a partial locking position where the side retainer 25 is retracted from the second accommodation chamber 21, as shown in FIG. 6, and a full locking position where the side retainer 25 is in the accommodation chamber 21, as shown in FIGS. 4 and 5.

The terminal unit 30 is a connecting member constituting a wiring harness for Ethernet (registered trademark) high-speed communication circuit of an automotive vehicle, and is configured by accommodating two inner conductors 31 into a dielectric 40. The inner conductor 31 is long in the front-rear direction and includes a rectangular tubular body 32, an elongated tab 33 projecting forward from the body 32, and a crimping portion 34 in the form of an open barrel connected to the rear end of the body 32. A front part of a wire 35 is fixed conductively to the crimping portion 34. Two of the wires 35 connected to two inner conductors 31 constitute a twisted pair cable 36.

The dielectric 40 is configured by uniting a first component 41 made of synthetic resin and having a halved shape and a second component 52 made of synthetic resin and having a halved shape in the vertical direction (direction intersecting axes of the front end parts of the wires 35). The first component 41 is made of polybutylene terephthalate (PBT) and includes an upper wall 42 elongated in the front-rear direction, left and right side walls 43 extending down from both left and right side edges of the upper wall 42 and a separation wall 44 extending down from a central part of the upper wall 42 in the front-rear direction. Regions between the two side walls 43 and the separation wall 44 serve as left and right grooves 45 elongated in the front-rear direction. Left and right lock grooves 46 elongated in the front-rear direction are formed in outer side surfaces of the left and right separation walls 44.

A projection-like first locking portion 47 is formed integrally on a front part of the upper surface (outer surface) of the upper wall 42. The first locking portion 47 is disposed in a laterally central part of the upper wall 42. A front part of the first locking portion 47 is formed with an inclined surface 48 inclined with respect to the front-rear direction (inserting direction of the terminal unit 30 into the first housing 10 and the second housing 20). A rear end surface of the first locking portion 47 serves as a locking surface substantially at a right angle to the front-rear direction.

Left and right projections 49 in the form of ribs extend in the front-rear direction on the upper surface of the upper wall 42. The projections 49 are disposed in regions on both left and right sides of the upper wall 42 and outward of both left and right outer side surfaces of the first locking portion 47 in a lateral direction. The front ends of the left and right projections 49 are disposed substantially at the same position as the rear end of the first locking portion 47 in the front-rear direction. Thus, the entire projections 49 are disposed behind the first locking portion 47. Front end parts of the left and right projections 49 serve as front stops 50 having front stop surfaces substantially at a right angle to the front-rear direction. Rear end parts of the left and right projections 49 serve as second locking portions 51 having locking surfaces substantially at a right angle to the front-rear direction.

The second component 52 is made of polybutylene terephthalate (PBT) and includes a bottom wall 53 elongated in the front-rear direction and left and right outer walls 54 extending up from both left and right sides of the bottom wall 53. Lock ribs 55 are formed on the inner surfaces of extending ends of the both left and right outer walls 54.

In assembling the first component 41 and the second component 52, the bodies 32 and the crimping portions 34 of the inner conductors 31 are accommodated into the left and right grooves 45 of the first component 41. The first component 41 and the second component 52 are divided and united in the vertical direction intersecting substantially at a right angle to the front end parts of the wires 35. Thus, a moving direction of the inner conductors 31 when the inner conductors 31 are mounted into the first component 41 also is a direction intersecting substantially at a right angle to the axes of the front end parts of the wires 35. In this way, an untwisted length of the wires 35 can be suppressed as short as possible in the front parts of the two wires 35 constituting the twisted pair cable 36 so that a reduction of a noise reducing function caused by the untwisting of the wires 35 can be avoided.

After the two inner conductors 31 are mounted into the first component 41, the second component 52 is assembled to be united with the first component 41 from below. The united first component 41 and second component 52 are held united by the locking of the lock grooves 46 and the lock ribs 55. An assembling direction of the second component 52 with the first component 41 intersects the axes of the front parts of the wires 35 at a substantially right angle. When the first and second components 41 and 52 are united, the dielectric 40 is configured and the inner conductors 31 are mounted in the dielectric 40 to complete the assembling of the terminal unit 30.

A rubber plug 18 is mounted on the outer periphery of the twisted pair cable 36 in advance, and the terminal unit 30 then is inserted into the first accommodation chamber 13 from behind the first housing 10 with the front retainer 17 held at the partial locking position. In the process of inserting the terminal unit 30, the inclined surface 48 of the first locking portion 47 resiliently deflects the first locking lance 14.

When the terminal unit 30 is inserted properly, the front stops 50 butt against the first stoppers 15 to stop the terminal unit 30 in front and the first locking portion 47 is locked to the first locking lance 14 to retain the terminal unit 30 with respect to the first housing 10. Further, an opening on the rear end of the first accommodation chamber 13 is closed in a liquid-tight manner by the rubber plug 18 to achieve primary locking of the terminal unit 30.

After the terminal unit 30 is inserted properly, the front retainer 17 is pushed from the partial locking position to the full locking position to enter the deflection space 16. In this way, the resilient deflection of the first locking lance 14 in a direction separating from the first locking portion 47 is restricted to achieve secondary locking of the terminal unit 30. As just described, the terminal unit 30 is retained reliably by primary locking with the first locking lance 14 and secondary locking with the front retainer 17.

In mounting the terminal unit 30 into the second housing 20, the terminal unit 30 is inserted into the second accommodation chamber 21 with the side retainer 25 held at the partial locking position. In the process of inserting the terminal unit 30, the inclined surface 48 of the first locking portion 47 resiliently deflects the second locking lance 22. When the terminal unit 30 is inserted properly, the front stops 50 butt against the second stoppers 23 to stop the terminal unit 30 in front, and the first locking portion 47 is locked to the second locking lance 22 to retain the terminal unit 30 with respect to the second housing 20 and to achieve primary locking of the terminal unit 30.

After the terminal unit 30 is inserted properly, the side retainer 25 is pushed from the partial locking position to the full locking position to enter the second accommodation chamber 21. In this way, the side retainer 25 is locked to the second locking portions 51 from behind to achieve secondary locking of the terminal unit 30. As just described, the terminal unit 30 is retained reliably by primary locking with the second locking lance 22 and secondary locking with the side retainer 25.

The first connector A is configured by inserting the terminal unit 30 into the first accommodation chamber 13 formed in the first housing 10. Further, the second connector B is configured by inserting the terminal unit 30 into the second accommodation chamber 21 formed in the second housing 20.

The terminal unit 30 includes the inner conductors 31 having the tabs 33 projecting forward from the bodies 32 and the dielectric 40 configured to hold the inner conductors 31 while accommodating the bodies 32, and is mounted into a selected one of the first and second housings 10 and 20. In other words, the terminal unit 30 can be mounted into either the first housing 10 or the second housing 20 and is mounted into the selected first or second housing 10 or 20 according to need.

The first housing 10 includes the resiliently deflectable first locking lance 14, the front retainer 17 capable of restricting the resilient deflection of the first locking lance 14 and the first accommodation chamber 13. The second housing 20 includes the resiliently deflectable second locking lance 22, the second accommodation chamber 21 and the side retainer 25 facing the second accommodation chamber 21.

The first locking portion 47 and the second locking portion 51 are formed on the outer surface of the dielectric 40. With the terminal unit 30 inserted in the first accommodation chamber 13, the first locking portion 45 is locked to the first locking lance 14 and the front retainer 17 restricts the resilient deflection of the first locking lance 14. In the above way, the terminal unit 30 is retained reliably. Further, with the terminal unit 30 inserted in the second accommodation chamber 21, the terminal unit 30 is retained reliably by the locking of the first locking portion 47 and the second locking lance 22 and the locking of the second locking portion 51 and the side retainer 25.

As just described, the reliability of a function for retaining the terminal unit 30 is excellent regardless of whether the terminal unit 30 is mounted into the first housing 10 or the second housing 20. Further, the terminal unit 30 can be used as a common member for the waterproof first housing 10 and the non-waterproof second housing 20, which are of different types.

Further, the first locking portion 47 and the second locking portions 51 are disposed on the same plane (outer surface of the upper wall portion 42) of the outer surface of the dielectric 40 and at different positions in a width direction (lateral direction) intersecting the inserting direction into the first or second accommodation chamber 13 or 21. According to this configuration, the first locking portion 47 will not interfere with the side retainer 25 and the second locking portions 51 will not interfere with the first and second locking lances 14, 22 even though the first and second locking portions 47, 51 are arranged on the same plane (outer surface of the upper wall 42).

Further, the front stops 50 are formed on front sides of the second locking portions 51 in the inserting direction on the outer surface of the dielectric 40 and are configured to restrict a movement of the terminal unit 30 into the first or second accommodation chamber 13 or 21 beyond a proper insertion position. The first and second locking lances 14, 22 do not resiliently come into contact at a position where the front stops 50 are formed. Thus, even though the front stop 50 are formed on the same plane (outer surface of the upper wall 42) as the first locking portion 47, insertion resistance due to the resilient interference of the front stops 50 with the first or second locking lance 14 or 22 is not generated.

Further, the second locking portion 51 and the front stop 50 are formed integrally to the single projection 49. According to this configuration, the strengths of the second locking portion 51 and the front stop 50 is enhanced as compared to the case where the second locking portion 51 and the front stop 50 project separately.

Further, the left and right projections 49 are disposed on both sides across the first locking portion 47 in the width direction (lateral direction) intersecting the inserting direction into the first or second accommodation chamber 13 or 21. According to this configuration, the projections 49 are disposed to sandwich the first or second locking lance 14 or 22 locked by the first locking portion 47 to prevent a positional deviation of the first or second locking lance 14 or 22 in the width direction.

The invention is not limited to the above described and illustrated embodiment. For example, the following embodiments also are included in the scope of the invention.

Although the first and second locking portions are disposed on the same plane of the outer surface of the dielectric in the above embodiment, the first and second locking portions may be disposed in regions on opposite sides of the outer surface of the dielectric.

Although the front stops are on the same plane as the first and second locking portions in the above embodiment, the front stops may be in a planar region different from that for the first and second locking portions.

Although the second locking portion and the front stop are formed integrally to the single projection in the above embodiment, the second locking portion and the front stop may be independent projections.

Although the two projections are disposed to sandwich the first or second locking lance in the width direction in the above embodiment, a projection may be disposed to extend along only one side surface of the first or second locking lance.

Although only one first locking portion is provided in the above embodiment, two or more first locking portions may be provided.

Although two of the second locking portions are formed in the above embodiment, one, three or more second locking portions may be provided.

Although two of the front stops are formed in the above embodiment, one, three or more second front stop portions may be provided.

Although two inner conductors are mounted into one dielectric in the above embodiment, one, three or more inner conductors may be accommodated into one dielectric.

Although the dielectric is composed of two components, i.e. the first and second components, in the above embodiment, the dielectric may be composed of a single component.

Although two wires connected to the inner conductors constitute the twisted pair cable in the above embodiment, the invention can be applied also when a wire connected to an inner conductor does not constitute a twisted pair cable.

Although the first component is made of polybutylene terephthalate (PBT) in the above embodiment, the first component may be made of a material other than polybutylene terephthalate.

Although the second component is made of polybutylene terephthalate (PBT) in the above embodiment, the second component may be made of a material other than polybutylene.

Although both the first component and the second component are made of polybutylene terephthalate (PBT) in the above embodiment, a material combination of the first component and the second component may be polyethylene terephthalate (PET) and polypropylene (PP), polybutylene terephthalate and polyethylene (PE) or polybutylene terephthalate and foamed polybutylene terephthalate.

LIST OF REFERENCE SIGNS

A . . . first connector (connector)
B . . . second connector (connector)
10 . . . first housing
13 . . . first accommodation chamber
14 . . . first locking lance
17 . . . front retainer
20 . . . second housing
21 . . . second accommodation chamber
22 . . . second locking lance
25 . . . side retainer
30 . . . terminal unit
31 . . . inner conductor
32 . . . body portion
33 . . . tab
40 . . . dielectric
47 . . . first locking portion
49 . . . projection
50 . . . front stop portion
51 . . . second locking portion

The invention claimed is:

1. A terminal unit, comprising:

an inner conductor including a tab projecting forward from a body; and a dielectric configured to hold the inner conductor while accommodating the body;

the terminal unit being mountable into a selected one of a first housing and a second housing, the first housing including a resiliently deflectable first locking lance, a front retainer capable of restricting resilient deflection of the first locking lance and a first accommodation chamber and the second housing including a resiliently deflectable second locking lance, a second accommodation chamber and a side retainer facing the second accommodation chamber, wherein:

a first locking portion and a second locking portion are formed on an outer surface of the dielectric;

the terminal unit is retained by the front retainer restricting the resilient deflection of the first locking lance and the first locking portion being locked to the first locking lance with the terminal unit inserted in the first accommodation chamber; and the terminal unit is retained by locking of the first locking portion and the second locking lance and locking of the second locking portion and the side retainer with the terminal unit inserted in the second accommodation chamber.

2. The terminal unit of claim 1, wherein the first locking portion and the second locking portion are disposed on one plane of the outer surface of the dielectric and at different positions in a width direction intersecting an inserting direction into the first accommodation chamber or the second accommodation chamber.

3. The terminal unit of claim 2, wherein a front stop configured to restrict a movement of the terminal unit inserted into the first accommodation chamber or the second accommodation chamber beyond a proper insertion position is formed on a front side of the second locking portion in the inserting direction on the outer surface of the dielectric.

4. The terminal unit of claim 3, wherein the second locking portion and the front stop are formed integrally to a single projection.

5. The terminal unit of claim 4, wherein two of the projections are disposed on both sides across the first locking portion in the width direction intersecting the inserting direction into the first accommodation chamber or the second accommodation chamber.

6. A connector configured by inserting a terminal unit into a selected one of a first accommodation chamber formed in a first housing and a second accommodation chamber formed in a second housing, the terminal unit including an inner conductor having a tab projecting forward from a body and a dielectric configured to hold the inner conductor while accommodating the body, comprising:

a resiliently deflectable first locking lance formed in the first accommodation chamber;

a front retainer configured to restrict resilient deflection of the first locking lance by being mounted into the first housing;

a resiliently deflectable second locking lance formed in the second accommodation chamber;

a side retainer mounted into the second housing to face inside of the second accommodation chamber;

a first locking portion formed on an outer surface of the dielectric and configured to retain the terminal unit by being locked to the first locking lance when the terminal unit is inserted into the first accommodation chamber and to retain the terminal unit by being locked to the second locking lance when the terminal unit is inserted into the second accommodation chamber; and a second locking portion formed on the outer surface of the dielectric and configured to retain the terminal unit by being locked to the side retainer when the terminal unit is inserted into the second accommodation chamber.

* * * * *